US007827951B2

(12) United States Patent
Kofler et al.

(10) Patent No.: US 7,827,951 B2
(45) Date of Patent: Nov. 9, 2010

(54) GAS EXCHANGE VALVE ACTUATING APPARATUS

(75) Inventors: Hans Kofler, Stuttgart (DE); Robert Niklas, Weinstadt (DE); Christoph Reckzügel, Hohenstadt (DE)

(73) Assignee: Daimler AG, Stuttgart (DE)

( * ) Notice: Subject to any disclaimer, the term of this patent is extended or adjusted under 35 U.S.C. 154(b) by 451 days.

(21) Appl. No.: 11/982,739

(22) Filed: Nov. 2, 2007

(65) Prior Publication Data

US 2008/0105226 A1 May 8, 2008

Related U.S. Application Data

(63) Continuation-in-part of application No. PCT/EP2006/004060, filed on Apr. 29, 2006.

(30) Foreign Application Priority Data

May 6, 2005 (DE) ..... 10 2005 021 113

(51) Int. Cl.
*F01L 1/18* (2006.01)

(52) U.S. Cl. ..... 123/90.39; 123/90.12; 123/90.27; 123/90.44; 29/888.2; 74/569

(58) Field of Classification Search ..... 123/90.39, 123/90.44, 90.12, 90.13, 90.16, 90.27, 90.31; 29/888.2; 74/559, 567, 569
See application file for complete search history.

(56) References Cited

U.S. PATENT DOCUMENTS

| | | | | |
|---|---|---|---|---|
| 3,875,908 | A * | 4/1975 | Ayres | 123/90.36 |
| 4,441,465 | A | 4/1984 | Nakamura | |
| 4,615,306 | A * | 10/1986 | Wakeman | 123/90.16 |
| 2004/0244744 | A1 | 12/2004 | Falkowski et al. | |

FOREIGN PATENT DOCUMENTS

| | | |
|---|---|---|
| DE | 43 18 293 | 12/1983 |
| DE | 198 40 404 | 5/2000 |
| EP | 0 156 996 | 10/1985 |
| EP | 0 259 106 | 3/1988 |
| JP | 58 005416 | 1/1983 |
| JP | 60-184936 | 9/1985 |

* cited by examiner

*Primary Examiner*—Ching Chang
(74) *Attorney, Agent, or Firm*—Klaus J. Bach

(57) ABSTRACT

In a gas exchange valve operating apparatus with at least one overhead camshaft for actuating the gas exchange valves, with a hydraulic medium supply passage extending through the camshaft and with at least one hydraulic switchable support unit cooperating with a lever-like cam follower which is disposed on a switchable support unit and on a gas exchange valve and is furthermore in contact with the overhead camshaft, the support unit is disposed in communication with at least one pressure medium supplied via the hydraulic medium supply passage of the camshaft.

6 Claims, 3 Drawing Sheets

GAS EXCHANGE VALVE ACTUATING APPARATUS

This is a Continuation-In-Part Application of pending international patent application PCT/EP2006/004060 filed Apr. 29, 2006 and claiming the priority of German patent application 10 2005 021 113.5 filed May 6, 2005.

BACKGROUND OF THE INVENTION

The invention relates to a gas exchange valve actuating apparatus for an internal combustion engine with an overhead camshaft and lever-like camshaft followers for operating the gas exchange valves.

DE 198 50 404 A1 discloses a gas exchange valve actuating apparatus which comprises a lever-like cam follower cooperating with an overhead camshaft. The cam follower is supported at a first end on a valve stem of a gas exchange valve and at its second end on another component.

It is the principal object of the present invention in to provide a switchable gas exchange valve actuating apparatus with an advantageous pressure medium supply for the cam follower support.

SUMMARY OF THE INVENTION

In a gas exchange valve operating apparatus with at least one overhead camshaft for actuating the gas exchange valves, with a hydraulic medium supply passage extending through the camshaft and with at least one hydraulic switchable support unit cooperating with a lever-like cam follower which is disposed on a switchable support unit and on a gas exchange valve and is furthermore in contact with the overhead camshaft, the support unit is disposed in communication with at least one pressure medium supplied via the hydraulic medium supply passage of the camshaft.

The term "overhead camshaft" is to be understood in this context as meaning, in particular, a camshaft which in its installation position is arranged at least partially above the support unit and, in particular, in a cylinder head.

By virtue of the solution according to the invention, a packaging-optimized gas exchange valve actuating apparatus switchable into various modes and having an advantageous pressure medium supply can be provided in particular, in that costly deep-hole bores in a cylinder head and/or in a crankcase can be avoided and also pressure losses can at least be reduced. Furthermore, an undesirable idling of supporting elements of the support unit can be avoided, rapid filling of the pressure medium passages and control spaces after restarting the engine can be ensured, and undesirable starting noises caused by delayed filling can be eliminated. The support unit may in this case be arranged on a side of the cam follower which faces a gas exchange valve and/or, particularly advantageously, on a side of the cam follower which faces away from the gas exchange valve, whereby the arrangement becomes quite compact.

Various pressure medium supply circuits of the support unit which seem to be expedient to a person skilled in the art may be coupled via one and/or via a plurality of camshaft ducts. Particularly advantageously, however, a pressure medium supply circuit, formed by a switching circuit, of the support unit is coupled to the pressure medium supply via the camshaft duct, as a result of which an especially reliable pressure medium supply of the switching circuit with low pressure medium losses can be achieved and an undesirable idling of switching elements can be reliably avoided.

Furthermore, a gas exchange valve actuating apparatus is proposed, with at least one overhead camshaft and with at least one hydraulic switchable support unit cooperating with a cam follower, at least one pressure medium supply circuit formed by a switching circuit and at least one further pressure medium supply circuit of the support unit being of the double-flow design. The term "double-flow" is to be understood in this context as meaning, in particular, that the further pressure medium supply circuit extends past at least one switching valve of the switching circuit and/or that different pressures can be implemented at a time point in the switching circuit and in the further pressure medium supply circuit. By virtue of a corresponding solution according to the invention, pressure losses can be reduced, and, in particular, switching can be implemented at low loads and/or rotational speeds.

The support unit advantageously comprises a play compensation element, so that play within a force flux of the gas exchange valve actuating apparatus can be compensated and a specific opening stroke and specific closing stroke can always be generated accurately.

The play compensation element may in this case be arranged within the force flux of the gas exchange valve actuating apparatus in various positions which seem to be expedient to a person skilled in the art, such as, in particular, on a side of the cam follower which faces the gas exchange valve, within the cam follower and/or on a side of the cam follower which faces away from the gas exchange valve, and may in this case, in particular, also be arranged separately from a switching means, such as a switching piston, of the support unit, for example on a side lying opposite with respect to the cam follower.

Particularly advantageously, however, the play compensation element is arranged at least partially within a switching means of the support unit and/or is produced at least partially in one piece with a switching means of the support unit, with the result that, in particular, construction space can be saved.

In a further refinement of the invention, a pressure medium supply circuit of the play compensation element is coupled to the pressure medium supply via the camshaft duct, as a result of which, an especially reliable pressure medium supply for the play compensation element with low pressure medium losses can be achieved and an undesirable idling of the play compensation element can be reliably avoided.

Furthermore, the pressure medium supply circuit formed by the switching circuit and a pressure medium supply circuit of the play compensation element may be of a double-flow design, with the result that an advantageous basic supply of the play compensation element and a switching of the support unit at low loads and/or rotational speeds can always be implemented.

An exemplary embodiment of the invention will be described below with reference to the accompanying drawings.

DESCRIPTION OF THE PREFERRED EMBODIMENTS

Figure 1:
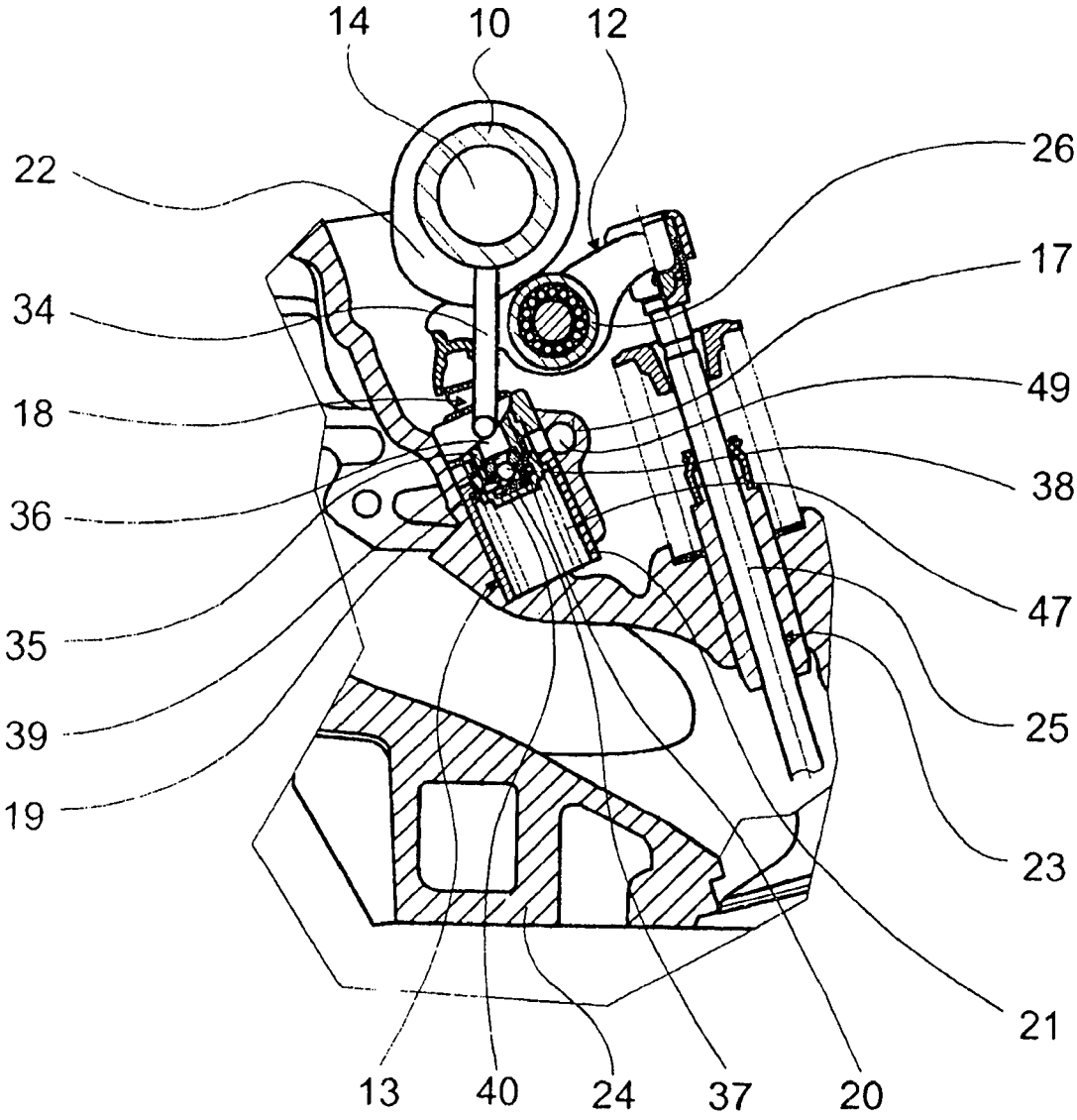
FIG. 1 shows a detail of an internal combustion engine with a partially diagrammatically illustrated gas exchange valve actuating apparatus.

FIG. 1 shows a detail of an internal combustion engine of a motor vehicle with a gas exchange valve actuating apparatus according to the invention. The gas exchange valve actuating apparatus comprises two overhead camshafts 10, 10' (FIG. 2) arranged in one half of a cylinder head 24 and, for each gas exchange valve 23, a cam follower 12 designed as a drag lever.

The camshafts 10, 10' cooperate by their cams 22 in each case with the cam follower 12. The more detailed set-up is described with reference to the camshaft 10, the cam follower 12, a support unit 13 and the gas exchange valve 23 in FIG. 1, but applies at least essentially to any of the other gas exchange valves not illustrated, of the internal combustion engine. The cam follower 12, the support unit 13 and the gas exchange valve 23 are representative for the units which are not illustrated.

The cam follower 12 is supported at its end facing away from the gas exchange valve 23 on the cylinder head 24 via the hydraulic switchable support unit 13 and, at its end facing the gas exchange valve 23, on a gas exchange valve stem 25, while the cam 22 of the camshaft 10 is in contact with the cam follower 12 in the middle region of the cam follower 12, via a roller 26 mounted on rolling bearings on the cam follower 12.

Figure 2:
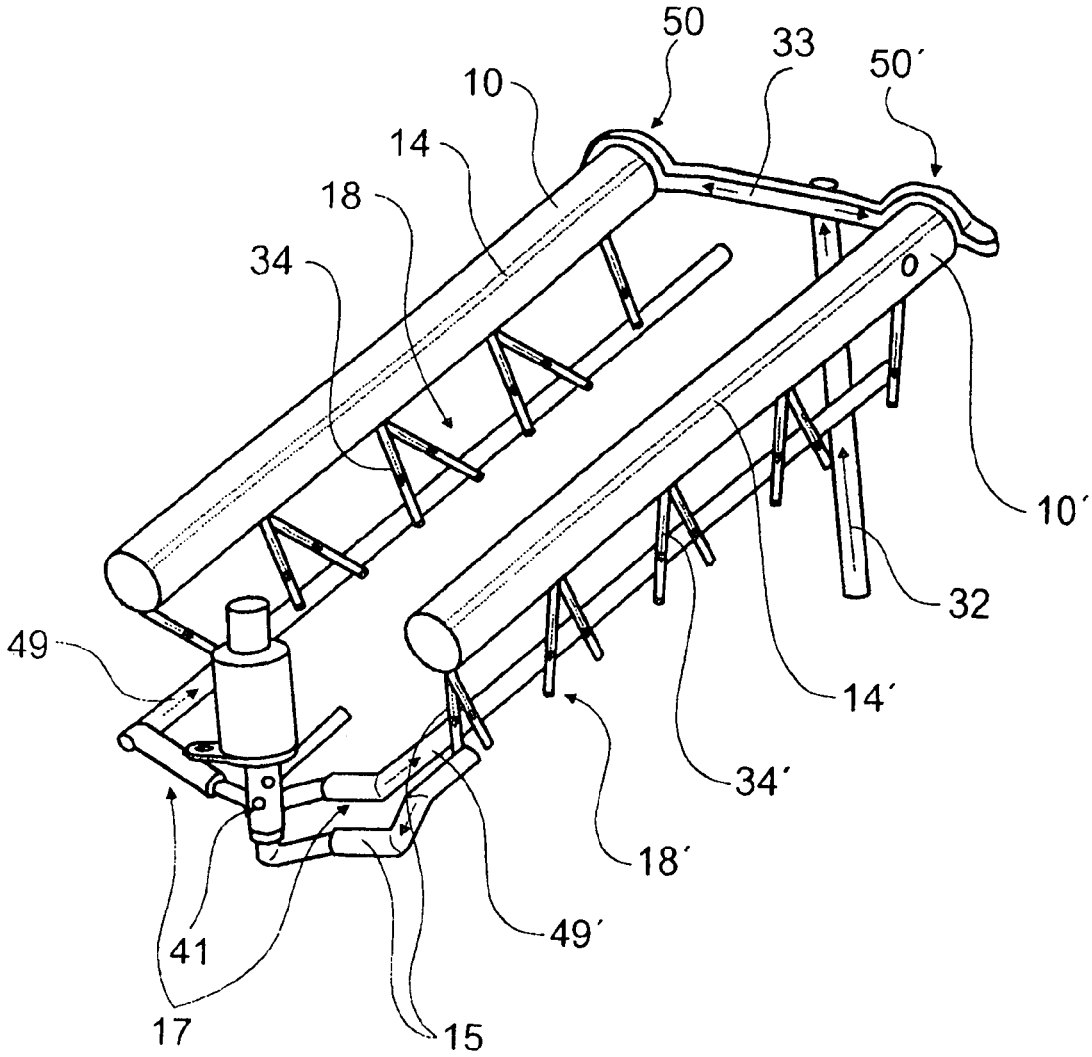
FIG. 2 shows an oil supply arrangement.
Figure 3:
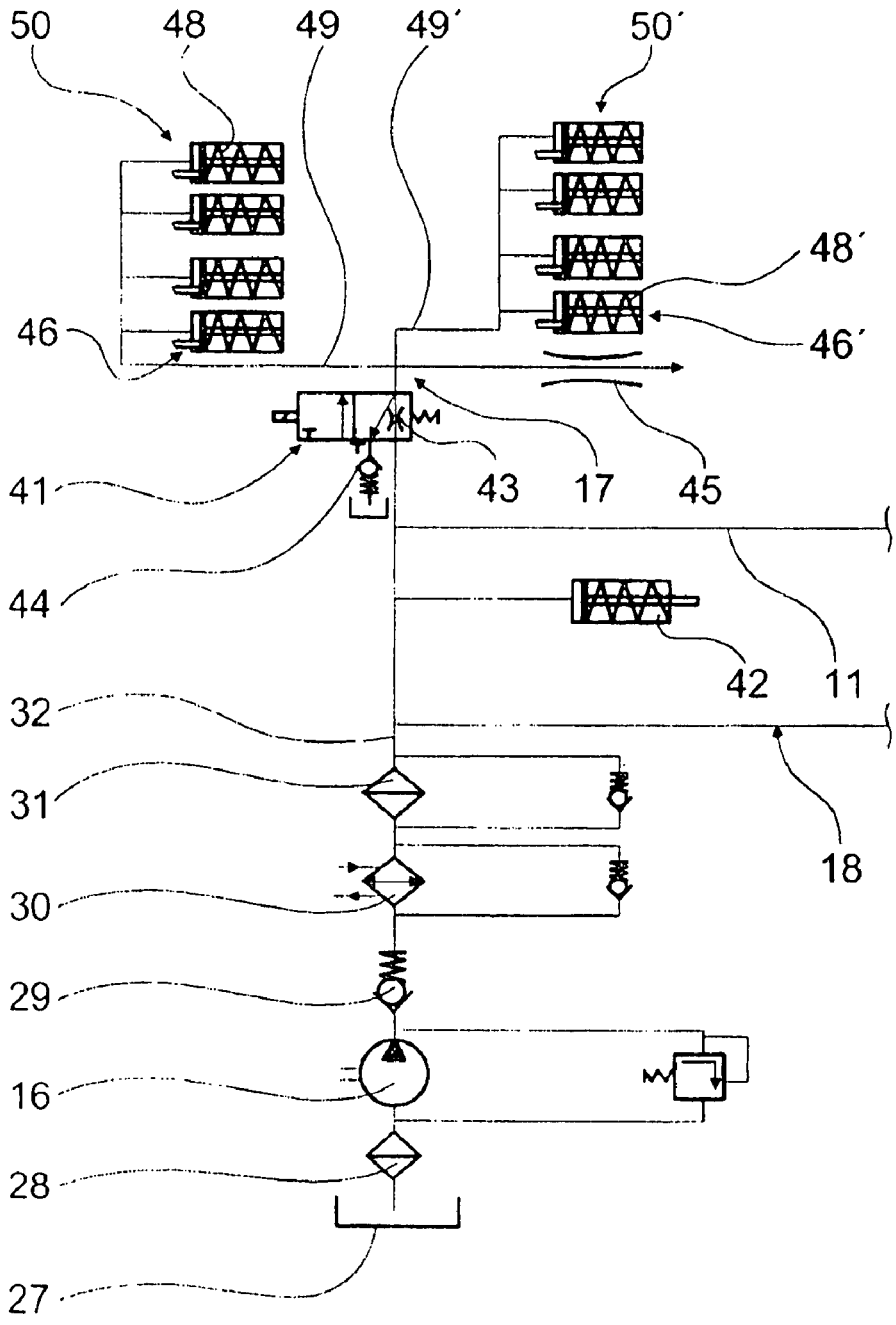
FIG. 3 is a circuit diagram of the gas exchange valve actuating apparatus of FIGS. 1 and 2.

The camshafts 10, 10' are hollow shafts and have in each case a camshaft duct 14, 14' extending in the axial direction through the camshafts 10, 10', the support units 13 of the gas exchange valves 23 of the cylinder head 24 being coupled via the camshaft ducts 14, 14' to a pressure medium supply 16 formed by a pump (FIGS. 1 to 3). During operation, the pressure medium supply 16 sucks in pressure medium from an oil pan 27 via a suction basket 28 and conveys it via a non-return valve 29, an oil/water heat exchanger 30 with a bypass, and an oil filter 31 with a bypass into a duct 32 formed by a bore in the cylinder head 24 (FIGS. 2 and 3). Starting from the duct 32, the pressure medium is conducted via a transverse branch duct 33 into the camshaft ducts 14, 14' (FIG. 2). Moreover, the duct 32 is coupled to a spring accumulator 42 (FIG. 3).

Distributed over the length of the camshafts 10, 10', transverse ducts 34, 34' formed by three-dimensional space bores in the cylinder head 24, starting from bearing points of the camshafts 10, 10', extend from the camshaft ducts 14, 14' to the gas exchange valves 23 (FIG. 1). The transverse ducts 34, 34' form part of a pressure medium supply circuit 18 for play compensation elements 19 of the support units 13. The play compensation element 19 is arranged within a switching means 20 formed by a piston and within a switching means 21 of the support unit 13, the switching means 21 guiding the switching means 20 and being formed by a cylinder (FIG. 1). The play compensation element 19 comprises a compensating piston 35 guided in the switching means 21, a first pressure space 36 coupled to the transverse duct 34, and a second pressure space 37, which is delimited by a bottom part 40 of the switching means 20 and which is in communication with the first pressure space 36 via a compensating passage 39 of the play compensation element 19. The compensating passage is controlled by a spring-loaded valve ball 38. The second pressure space 37 is connected to a tank' via a throttle duct which is implemented by a bearing point of the compensating piston 35 in the switching means 20.

At an end of the camshaft 10' which faces away from the transverse branch duct 33, pressure medium is conducted out of the camshaft duct 14' via a bearing structure of the camshaft 10' and via a duct 15, which is actually formed by a passage in the cylinder head 24, to a 3/2-way valve 41 of the support unit 13, said 3/2 way valve being formed by a magnetic switching valve and being an integral part of a pressure medium supply circuit 17, formed by a switching circuit, of the support unit 13 (FIGS. 1 to 3). Alternatively or additionally, the camshaft duct 14 could also be utilized for the pressure supply of a switching circuit.

With gas exchange valves 23 activated, a pressure throttled by a throttle 43 of the 3/2-way valve 41 prevails in the pressure medium supply circuit 17 formed by the switching circuit. The pressure medium supply circuit 18 of the play compensation element 19 branches off upstream of the 3/2-way valve 41. During operation, with the gas exchange valves 23 activated, different pressures prevail in the pressure medium supply circuit 17 formed by the switching circuit and in the pressure medium supply circuit 18 of the play compensation element 19, specifically a higher pressure in the pressure medium supply circuit 18 of the play compensation element 19 than in the pressure medium supply circuit 17 formed by the switching circuit. The pressure medium supply circuit 17 formed by the switching circuit and the pressure medium supply circuit 18 of the play compensation element 19 are consequently of a double-flow design.

During operation, with the gas exchange valves 23 activated, the pressure medium supply circuit 17 is connected to a tank via a non-return valve 44 (FIG. 3). Each support unit 13 has a switching pin 46, 46', by means of which the switching means 20 is fixed within the switching means 21, with the gas exchange valve drive activated (FIGS. 1 and 3). The control pins 46, 46' are in each case held in their interlocking positions by means of a spring element 48, 48'. Furthermore, the control pins 46 are coupled, on an inlet side 50, to the 3/2-way valve 41 on their sides lying opposite the spring elements 48, via a duct 49 formed by a deep-hole bore in the cylinder head 24, and the control pins 46', on an outlet side 50' are coupled to the 3/2-way valve 41, on their sides lying opposite the spring elements 48', via a duct 49' formed by a deep-hole bore in the cylinder head 24, the control pins 46 and 46' being biased toward their unblocking position by a pressure prevailing in the pressure medium supply circuit 17 formed by the switching circuit (FIGS. 2 and 3). In each case, only one deep hole bore in the cylinder head 24 is provided for each inlet side 50 and for each outlet side 50' and is coupled in each case to a vent 45.

When the gas exchange valve drive is to be switched off, the 3/2-way valve 41 is changed over and the pressure medium supply circuit 17 is acted upon directly, via the 3/2-way valve 41, by the pressure prevailing in the camshaft ducts 14, 14'. The control pins 46, 46' are displaced into their unlocking positions counter to the spring force of the spring elements 48, 48', so that, during operation, the switching means 20 of the support units 13 can in each case move into the switching means 21 counter to a spring force of a spring element 47 of the support units 13, and actuation of the gas exchange valves 23 ceases (FIGS. 1 and 3).

When the gas exchange valve drive is to be activated again, the 3/2-way valve 41 is changed over again, so that a throttled pressure is established once again in the pressure medium supply circuit 17 formed by the switching circuit, and the control pins 46, 46' can be moved to their locking positions by means of the spring elements 48, 48' counter to the throttled pressure in the pressure medium supply circuit 17.

A duct 11 formed by a bore in the cylinder head 24 leads to a further 3/2-way valve, not illustrated in any more detail, or to a pressure medium supply circuit, formed by a switching circuit, in a second half of the cylinder head 24 which is designed essentially according to the first half of the cylinder head 24.

In addition to the supply of the support units 13 of the gas exchange valve actuating apparatus, the camshaft ducts 14, 14' serve, furthermore, for the supply of lubricant to camshaft bearing points.

What is claimed is:

1. A gas exchange valve operating apparatus for an internal combustion engine with at least one overhead camshaft (10, 10') and with gas exchange valves (25) operated by the overhead camshaft (10, 10'), with at least one hydraulic switchable support unit (13) and a lever-like cam follower (12) disposed on the support unit (13) and the valve (25) so as to be operated by the camshaft (10, 10') via the cam follower (12), each camshaft (10, 10') including a pressure medium supply passage (14, 14') and communication means extending between the camshaft (10, 10') and the support unit (13) placing it in communication with at least one pressure medium supply (16) via the pressure medium supply passage (14, 14') for supplying lubricant to the gas exchange valves (25), and a switching circuit (17) including a pressure control valve (41) for the pressure medium formed in the switching circuit of the support unit (13), which is in communication with a pressure medium supply (16) via the camshaft pressure medium supply passage (14, 14'), and locking means (46, 48, 46', 48') for controlling the deactivation and reactivation of the valves depending on the pressure of the pressure medium in the switching circuit (17).

2. The gas exchange valve operating apparatus as claimed in claim 1, wherein the pressure medium supply circuit (17) formed by a switching circuit and a further pressure medium supply circuit (18) of the support unit (13) for controlling the valve play form a double-flow arrangement.

3. The gas exchange valve operating apparatus as claimed in claim 1, wherein the support unit (13) comprises a play compensation element (19).

4. The gas exchange valve operating apparatus as claimed in claim 3, wherein the play compensation element (19) is arranged at least partially within a switching means (20, 21) of the support unit (13) and includes as an integral part thereof, a switching means (20, 21).

5. The gas exchange valve operating apparatus as claimed in claim 2, wherein a pressure medium supply circuit (18) of the play compensation element (19) is in communication with the pressure medium supply (16) via the camshaft supply passage (14, 14').

6. An internal combustion engine with a gas exchange valve operating apparatus as claimed in claim 1.

* * * * *